US006637670B2

(12) United States Patent
Rodriguez-Amaya et al.

(10) Patent No.: US 6,637,670 B2
(45) Date of Patent: Oct. 28, 2003

(54) FUEL INJECTION DEVICE FOR AN INTERNAL COMBUSTION ENGINE HAVING A PRESSURE-HOLDING VALVE

(75) Inventors: Nestor Rodriguez-Amaya, Stuttgart (DE); Roger Potschin, Brackenheim (DE); Jürgen Gruen, Ditzingen (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/147,082

(22) Filed: May 17, 2002

(65) Prior Publication Data

US 2003/0006296 A1 Jan. 9, 2003

(30) Foreign Application Priority Data

May 17, 2001 (DE) ..... 101 23 993

(51) Int. Cl.[7] ..... F02M 47/02

(52) U.S. Cl. ..... 239/88; 239/533.2; 239/533.4; 239/533.8; 123/445

(58) Field of Search ..... 239/533.1–533.3, 239/533.8, 533.9, 533.4, 533.5, 88, 93, 575; 123/445, 446

(56) References Cited

U.S. PATENT DOCUMENTS 5,431,142 A * 7/1995 Bonse ..... 123/450
5,878,718 A * 3/1999 Rembold et al. ..... 123/456
6,058,912 A * 5/2000 Rembold et al. ..... 123/516
6,199,774 B1 * 3/2001 Ricco ..... 239/533.8
6,244,253 B1 * 6/2001 Haeberer et al. ..... 123/514
6,283,390 B1 * 9/2001 Brendle et al. ..... 239/533.2
6,484,699 B2 * 11/2002 Paul et al. ..... 123/525
2002/0170537 A1 * 11/2002 Reusing ..... 123/446

FOREIGN PATENT DOCUMENTS

EP 0 957 261 A2 * 11/1999 ..... F02M/47/02

* cited by examiner

*Primary Examiner*—Gregory L. Huson
*Assistant Examiner*—Amanda Flynn
(74) *Attorney, Agent, or Firm*—Ronald E. Greigg

(57) ABSTRACT

The fuel injection device has a fuel pump, which has a pump piston that is driven by an engine and delimits a pump working chamber, which is supplied with fuel from a fuel tank and is connected to a fuel injection valve, which has an injection valve member that controls at least one injection opening and can be moved by the pressure generated in the pump working chamber in an opening direction counter to a closing force. A first control valve controls a connection of the pump working chamber to a discharge chamber, and a second control valve controls the pressure prevailing in a control pressure chamber of the fuel injection valve. The connection of the pump working chamber further contains a pressure-holding valve, which maintains a pressure that is higher than the pressure prevailing in the discharge chamber.

8 Claims, 4 Drawing Sheets

FUEL INJECTION DEVICE FOR AN INTERNAL COMBUSTION ENGINE HAVING A PRESSURE-HOLDING VALVE

BACKGROUND OF THE INVENTION

1. Field of the Invention

The invention is directed to an improved fuel injection device for an internal combustion engine of the type having a fuel pump for each cylinder of the engine.

2. Description of the Prior Art

A fuel injection device of this kind has been disclosed by EP 0 957 261 A1. For each cylinder of the engine, this fuel injection device has a fuel pump that has a pump piston that is driven into a stroke motion by the engine and delimits a pump working chamber to which fuel is supplied from a fuel tank. The pump working chamber is connected to a fuel injection valve that has an injection valve member, which controls at least one injection opening and can be moved in the opening direction, counter to a closing force, by the pressure prevailing in a pressure chamber connected to the pump working chamber. A first electrically controlled control valve is provided, which controls a connection of the pump working chamber to the fuel tank, which functions as a discharge chamber. A second electrically controlled control valve is also provided, which controls the control pressure prevailing in a control pressure chamber, which pressure acts at least indirectly on the injection valve member in the closing direction. In this known fuel injection device, it is disadvantageous that because the unpressurized fuel tank or the pressure side of a fuel-supply pump is used as a discharge chamber, the pressure in the pump working chamber and in the regions of the fuel injection device connected to it drops sharply when connected to the discharge chamber and thus presents the danger of cavitation. In addition, the efficiency of the fuel injection device is not optimal as a result of this.

OBJECT AND SUMMARY OF THE INVENTION

The fuel injection device according to the invention has the advantage over the prior art that the pressure-holding valve maintains a pressure that is higher than the pressure in the discharge chamber so that the danger of cavitation is reduced and the efficiency is also improved. The pressure-holding valve also permits the simple execution of a preinjection at a limited pressure level.

In one embodiment, the pump working chamber is permitted to be decoupled from the pressure level maintained by the pressure-holding valve, which permits the prevention of leakage losses in the fuel pump.

BRIEF DESCRIPTION OF THE DRAWINGS

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
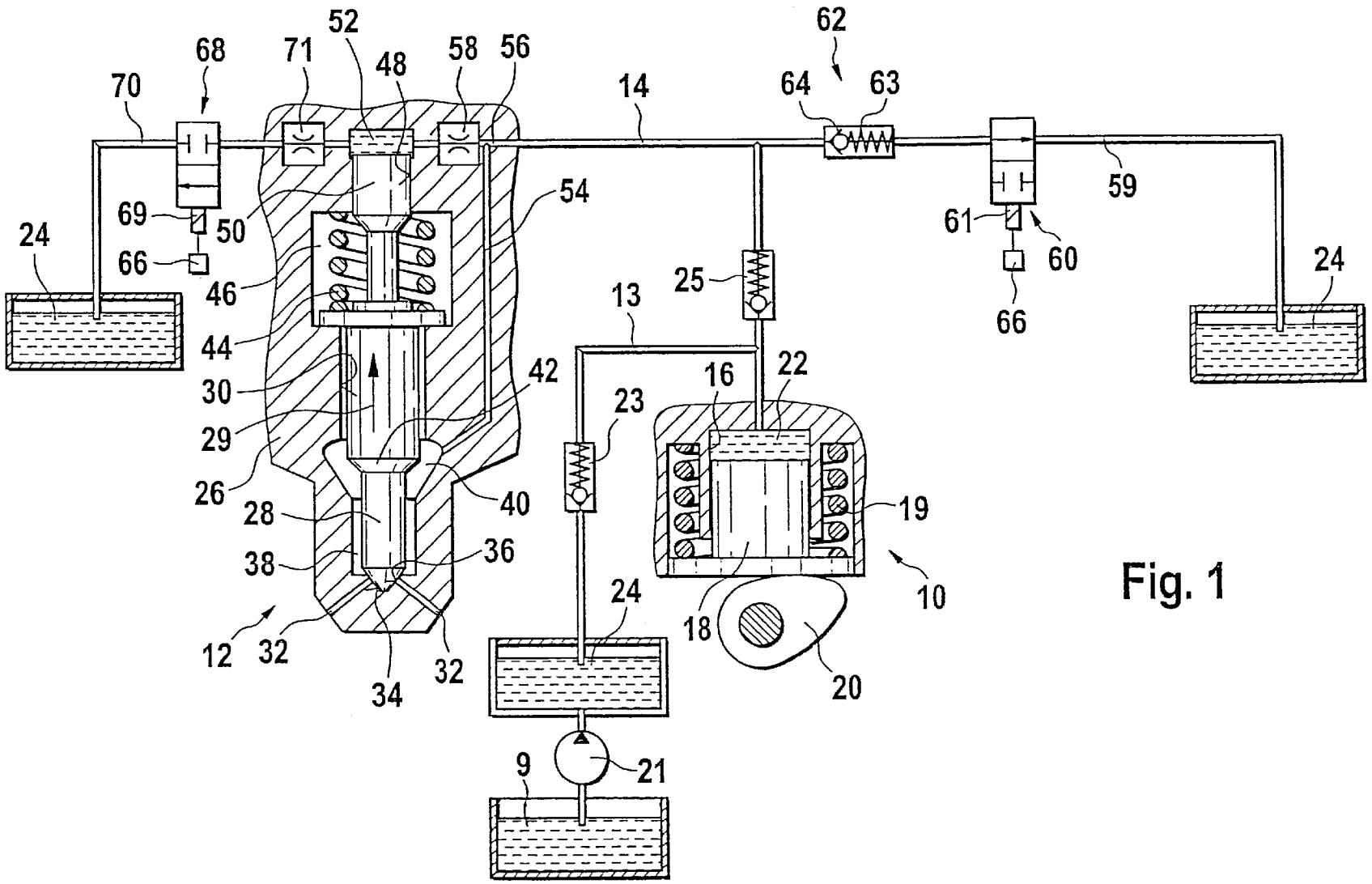
FIG. 1 is a schematic depiction of a first embodiment of a fuel injection device for an internal combustion engine.
Figure 3:
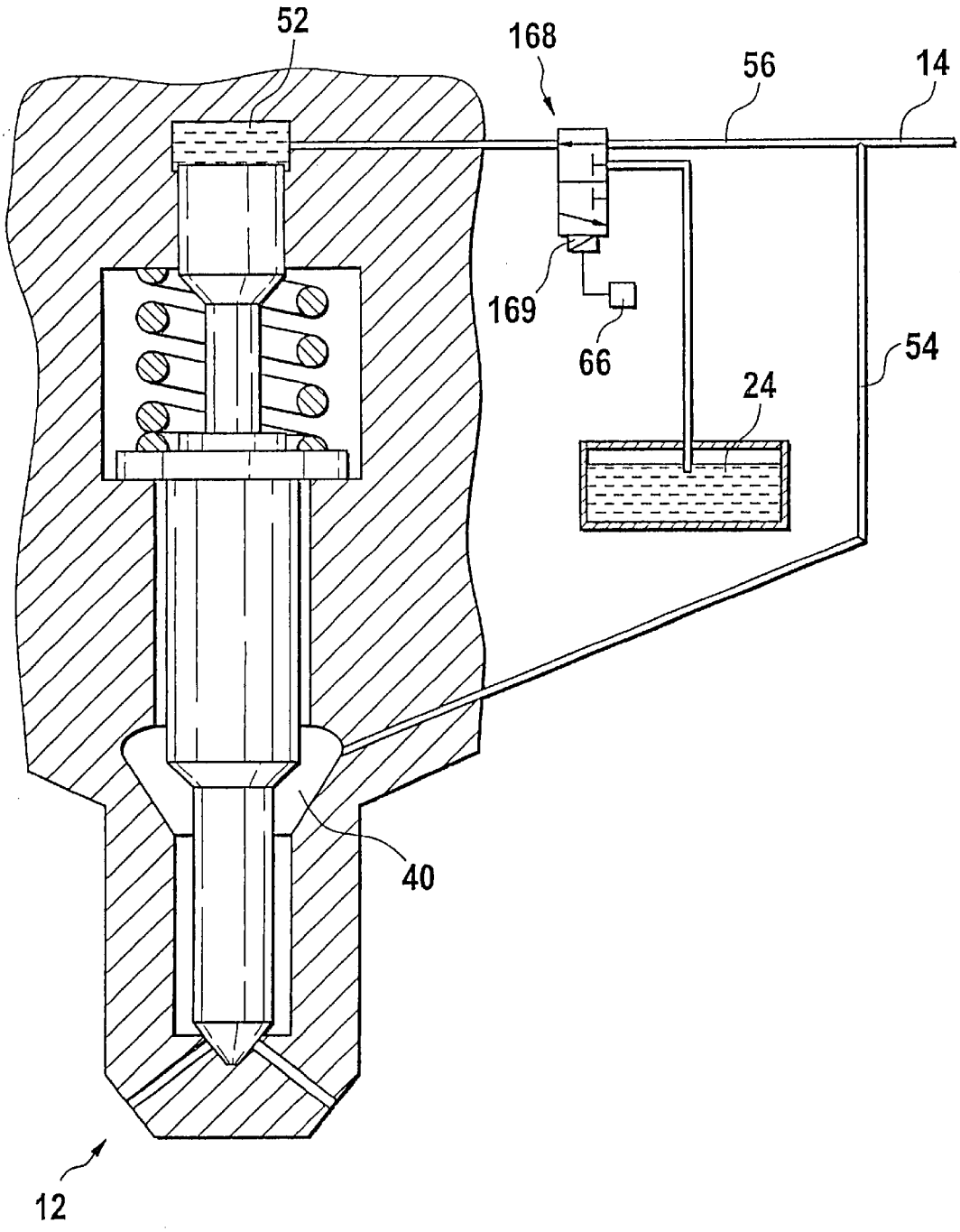
FIG. 3 shows a detail of a modified embodiment of the fuel injection device.
Figure 4:
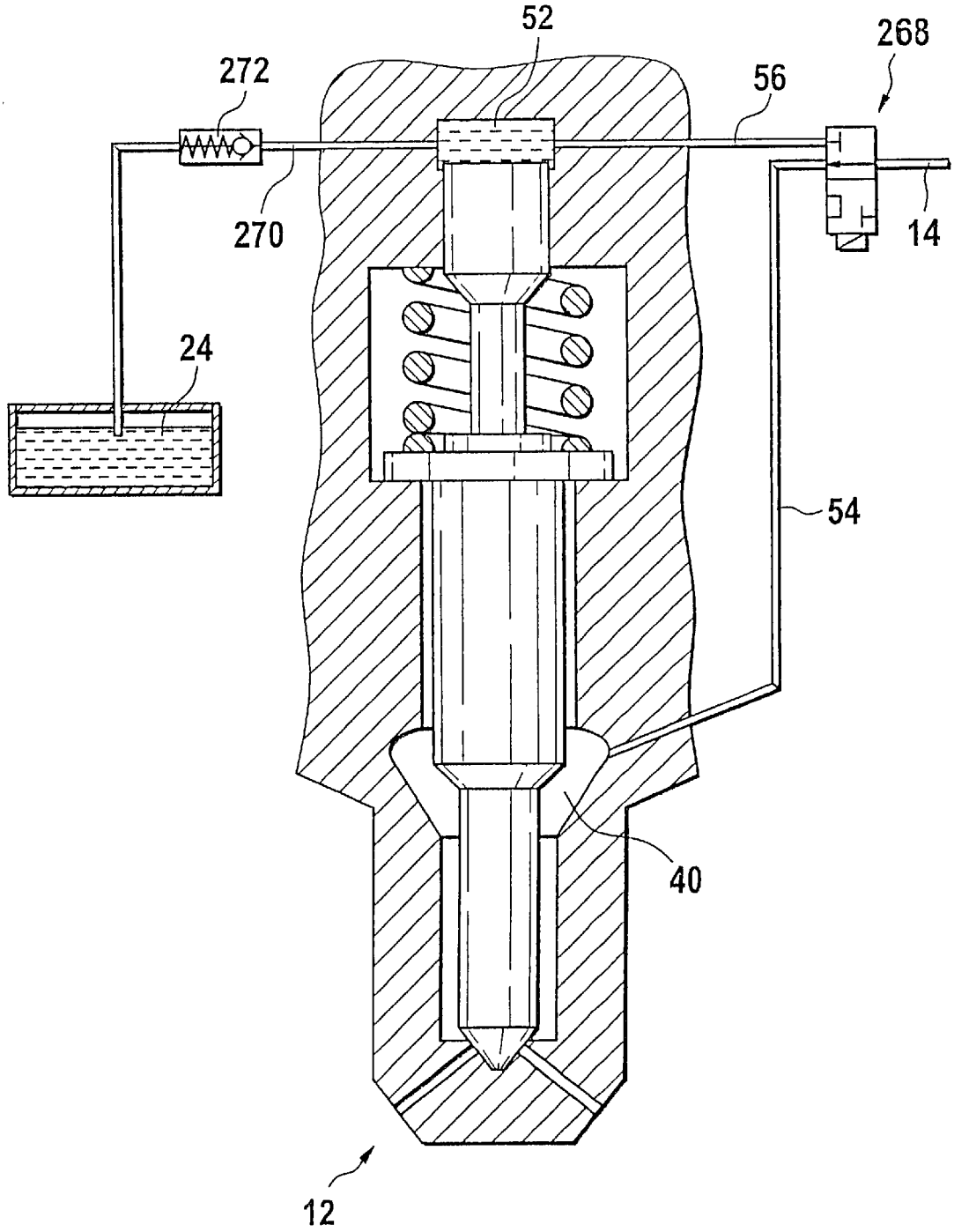
FIG. 4 shows a detail of another modified embodiment of the fuel injection device.

FIGS. 1, 3, and 4 show a fuel injection device for an internal combustion engine of a motor vehicle. Preferably, the engine is a compression-ignition motor. The fuel injection device is preferably embodied as a so-called unit pump system and, for each cylinder of the engine, has a respective fuel pump 10, a fuel injection valve 12, and a line 14 that connects the fuel injection valve 12 to the fuel pump 10. The fuel pump 10 has a pump piston 18 that is guided in a sealed fashion in a cylinder 16 and is driven into a stroke motion counter to the force of a restoring spring 19 by a cam 20 of a camshaft of the engine. In the cylinder 16, the pump piston 18 delimits a pump working chamber 22 in which fuel is compressed at high pressure during the delivery stroke of the pump piston 18. The pump working chamber 22 is supplied with fuel from a fuel tank 9 of the motor vehicle by means of the delivery pressure of a fuel-supply pump 21. It is possible for the fuel-supply pump 21 to supply fuel from the fuel tank 9 into a storage region 24 in which a pressure prevails that corresponds to the delivery pressure of the fuel-supply pump 21 and can be approx. 4 to 6 bar, for example. Fuel travels from the storage region 24 into the pump working chamber 22 during the intake stroke of the pump piston 18. A check valve 23 that opens toward the pump working chamber 22 is situated between the storage region 24 and the pump working chamber 22. An additional check valve 25 that opens out from the pump working chamber 22 is situated in the line 14. The supply line 13 from the fuel-supply pump 21 feeds in between the pump working chamber 22 and the additional check valve 25. For filling during the intake stroke of the pump piston 18, the pump working chamber 22 can alternatively also be connected to the storage region 24 via a connection that is controlled by the pump piston 18. In this case, the pump piston 18 uses a control edge to cooperate with an opening into the pump working chamber 22, which opening is part of the connection to the storage region 24 and is opened or closed by the pump piston 18. The check valve 23 can therefore be eliminated.

The fuel injection valve 12 is separate from the fuel pump 10 and is connected to the pump working chamber 22 via the line 14. The fuel injection valve 12 has a valve body 26, which can be comprised of multiple parts, in which an injection valve member 28 is guided so that it can move longitudinally in a bore 30. In its end region oriented toward the combustion chamber of the engine cylinder, the valve body 26 has at least one, preferably several, injection openings 32. In its end region oriented toward the combustion chamber, the injection valve member 28 has a sealing surface 34 that is approximately conical in shape, for example, and cooperates with a valve seat 36, which is embodied in the valve body 26 in its end region oriented toward the combustion chamber, and the injection openings 32 lead from this valve seat 36 or from a point downstream of it. At its end toward the valve seat 36, the valve body 26 contains an annular chamber 38 between the injection valve member 28 and the bore 30, and in its end region oriented away from the valve seat 36, this annular chamber 38 transitions via a radial enlargement of the bore 30 into a pressure chamber 40 that encompasses the injection valve member 28. The injection valve member 28 has a pressure shoulder 42 formed by a cross sectional reduction at the height of the pressure chamber 40. The end of the injection valve member 28 oriented away from the combustion chamber is engaged by a prestressed closing spring 44, which pushes the injection valve member 28 toward the valve seat 36. The closing spring 44 is disposed in a spring chamber 46 of the valve body 26, which adjoins the bore 30. At its end oriented away from the bore 30, the spring chamber 46 adjoins another bore 48 in the valve body 26, in which bore a piston 50 is guided in a sealed fashion, which is connected to the injection valve member 28. With its end oriented away from the injection valve member 28, the piston 50 delimits a control pressure chamber 52 in the valve body 26. The valve body 26 contains a conduit 54, which is fed by the line 14 to the fuel pump 10 and feeds into the pressure chamber 40.

A connection 56 to the control pressure chamber 52 branches from the conduit 54 of the fuel injection valve 12. The fuel injection device has a first control valve 60, which is situated close to the fuel pump 10 and can, for example, be integrated into the fuel pump 10. The first control valve 60 controls a connection 59 of the pump working chamber 22 of the fuel pump 10 to a discharge chamber, which function can be fulfilled at least indirectly by the storage region 24. The connection 59 branches from the line 14 downstream of the check valve 25. Upstream of the first control valve 60, the connection 59 contains a pressure-holding valve 62. For example, the pressure-holding valve 62 has a valve member 64 that is loaded by a closing spring 63 and can be moved in the opening direction toward the first control valve 60, counter to the force of the closing spring 63. The pressure-holding valve 62 maintains a pressure in the line 14 and therefore also in the pressure chamber 40 that is higher than the pressure in the discharge chamber 24.

The first control valve 60 can be electrically controlled and has an actuator 61, which can be an electromagnet or a piezoelectric actuator, which is electrically activated and can move a valve member of the control valve 60. The first control valve 60 can be pressure-compensated or non-pressure-compensated. The first control valve 60 is embodied as a 2/2-port directional-control valve that opens the connection 59 to the discharge chamber 24 in a first switching position and closes the connection 59 to the discharge chamber 24 in a second switching position. The control valve 60 is controlled by an electrical control unit 66 as a function of operating parameters of the internal combustion engine.

In order to control the pressure in the control pressure chamber 52, a second control valve 68 is provided, which controls a connection 70 of the control pressure chamber 52 to a discharge chamber, for example the discharge chamber 24. The second control valve 68 can be electrically controlled and has an actuator 69, which can be an electromagnet or a piezoelectric actuator, which is electrically activated and can move a valve member of the control valve 68. The second control valve 68 is preferably embodied as pressure-compensated. The second control valve 68 is embodied as a 2/2-port directional-control valve that shuts off the connection 70 of the control pressure chamber 52 to the discharge chamber 24 in a first switching position and opens the connection 70 of the control pressure chamber 52 to the discharge chamber 24 in a second switching position. A throttle restriction 58 is provided in the connection 59 of the control pressure chamber 52 to the line 14 and another throttle restriction 71 is provided in the connection 70 of the control pressure chamber 52 to the fuel tank 24, between the control pressure chamber 52 and the second control valve 68. The control unit 66 likewise controls the second control valve 68. The control unit 66 controls the control valves 60, 68 as a function of operating parameters of the engine, such as speed, load, and temperature.

The function of the fuel injection device will be explained below. During the intake stroke of the pump piston 18, fuel from the storage region 24 is supplied to the pump working chamber 22 through the open check valve 23 via the line 13. During the delivery stroke of the pump piston 18, the check valve 23 closes and the check valve 25 opens; the first control valve 60 is open, so that the connection 59 to the discharge chamber 24 is open. The fuel injection begins with a preinjection only at a pressure that is set by the pressure-holding valve 62 and can build up in the pump working chamber 22, the line 14, and the pressure chamber 40 of the fuel injection valve 12. When the pressure set by the pressure-holding valve 62 is exceeded, the pressure-holding valve 62 opens and fuel flows through the open first control valve 60 and the connection 59, into the discharge chamber 24. Subsequently, the pressure prevailing in the line 14 and the pressure chamber 40 remains at least almost constant. The opening pressure of the pressure-holding valve 62 is determined by the prestressing of its closing spring 63. The control unit 66 opens the second control valve 68 so that high pressure cannot build up in the control pressure chamber 52, despite its connection 56 to the line 14, but rather, this pressure is discharged into the discharge chamber 24. The throttle restrictions 58 and 71 achieve the fact that only a small quantity of fuel can escape from the conduit 54 into the discharge chamber 24. When the pressure prevailing in the pressure chamber 40 has reached such a level that it exerts a force acting in the opening direction 29 on the injection valve member 28 via the pressure shoulder 42, which is greater than the force of the closing spring 44, then the injection valve member 28 lifts its sealing surface 34 up from the valve seat 36 and fuel is injected through the injection openings 32 into the combustion chamber of the engine cylinder. When the second control valve 68 is open, the opening pressure of the fuel injection valve 12 depends on the force of the closing spring 44 and the force exerted on the piston 50 by the residual pressure prevailing in the control pressure chamber 52.

Figure 2:
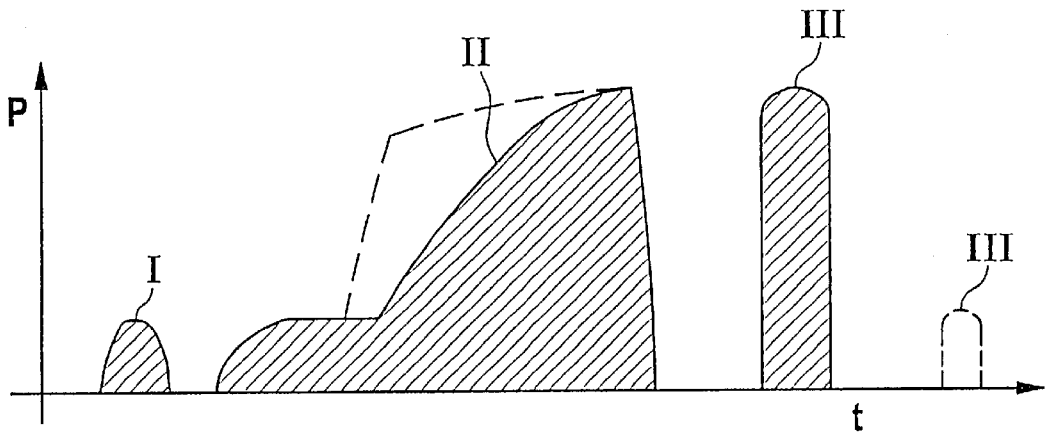
FIG. 2 shows a march of a pressure at injection openings of a fuel injection valve of the fuel injection device.

FIG. 2 shows the march of the pressure p at the injection openings 32 of the fuel injection valve 12 over time t during an injection cycle. The preinjection corresponds to an injection phase labeled I in FIG. 2. In order to terminate the preinjection, the control unit 66 closes the second control valve 68 so that the control pressure chamber 52 is shut off from the discharge chamber 24 and high pressure builds up in the control pressure chamber 52 via its connection 56 to the line 14. This causes the piston 50 to exert a force on the injection valve member 28, which works in concert with the force of the closing spring 44, so that the injection valve member 28 moves counter to its opening direction 29 and its sealing surface 34 comes into contact with the valve seat 36, terminating the preinjection.

For a subsequent main injection, the control unit 66 opens the second control valve 68 so that the control pressure chamber 52 is once again pressure relieved and the fuel injection valve 12 opens. The first control valve 60 can be open at the beginning of the main injection so that the connection 59 to the discharge chamber 24 is open and the pressure preset by the pressure-holding valve 62 builds up in the line 14 and the pressure chamber 40 of the fuel injection valve 12. The main injection then begins at the same pressure level at which the preinjection is executed. When the first control valve 60 is closed, the main injection begins at a higher pressure level than when the first control valve 60 is initially open. Then, the control unit 66 closes the first control valve 60 so that the connection 59 to the discharge chamber 24 is shut off and the main injection continues at a pressure in the pump working chamber 22, which is generated in accordance with the profile of the cam 20. It is also possible for the first control valve 60 to be closed at first, but for the second control valve 68 to remain closed so that no injection occurs as yet. The second control valve 68 is then opened only after a delay, which delays the beginning of the main injection and also causes this main injection to begin at a higher pressure. The main injection corresponds to the injection phase labeled II in FIG. 2, where the march of pressure depicted with a solid line is for the case in which the first control valve 60 is open at the beginning, and the march of pressure depicted with the dashed line is for the case in which the first control valve 60 is closed just at the beginning.

In order to terminate the main injection, the control unit 66 closes the second control valve 68 so that the control pressure chamber 52 is shut off from the discharge chamber 24 and high pressure builds up in the control pressure chamber 52 by means of its connection to the line 14 and thereby to the pump working chamber 22; this high pressure closes the fuel injection valve 12. The first control valve 60 remains closed so that the connection 59 to the accumulator 24 is closed. For a secondary injection, the control unit 66 opens the second control valve 68 again so that the control pressure chamber 52 is once again pressure relieved and the fuel injection valve 12 opens. The secondary injection occurs with a march of pressure that corresponds to the profile of the cam 20. In order to terminate the secondary injection, the control unit 66 closes the second control valve 68 and/or the control unit 66 opens the first control valve 60. The secondary injection corresponds to an injection phase labeled III in FIG. 2.

After the termination of the secondary injection, the second control valve 68 remains closed. An additional secondary injection depicted with dashed lines in FIG. 2 can be produced by means of the pressure that the pressure-holding valve 62 sets in the pressure chamber 40, the conduit 54, and the line 14. In this instance, the pressure chamber 40, the conduit 54, and the line 14 function as storage elements from which the fuel quantity for the additional secondary injection is drawn. For the additional secondary injection, the first control valve 60 is opened and the second control valve 68 is likewise temporarily opened. At the time of the additional secondary injection, the pump piston 18 can be in the process of executing the intake stroke in which the pump working chamber 22 is decoupled from the line 14 by means of the closed check valve 25.

FIG. 3 shows another embodiment of the fuel injection device, in which the fundamental design is essentially the same as in the embodiment explained above, but the disposition and embodiment of the second control valve 168 has been modified. The second control valve 168 can be electrically controlled and has an actuator 169, which can be an electromagnet or a piezoelectric actuator, which is electrically activated and can move a valve member of the control valve 168. The second control valve 168 is situated in the connection 56 of the control pressure chamber 52 to the conduit 54. The second control valve 168 is embodied as a 3/2-port directional-control valve with which, in a first switching position, the connection 56 of the control pressure chamber 52 to the conduit 54 and therefore to the pump working chamber 22 is open and the control pressure chamber 52 is shut off from the discharge chamber 24. In a second switching position of the second control valve 168, the control pressure chamber 52 is connected to the discharge chamber 24 and the connection 56 to the conduit 54 and therefore to the pump working chamber 22 is shut off. In order to permit the fuel injection valve 12 to open, the control unit 66 brings the second control valve 168 into its second switching position in which the control pressure chamber 52 is discharged into the discharge chamber 24 and in order to close the fuel injection valve 12, the second control valve 168 is brought into its first switching position in which the control pressure chamber 52 is connected to the conduit 54.

Otherwise, the operation of the fuel injection device according to this modified embodiment is equivalent to the one according to FIG. 1.

FIG. 4 shows another embodiment of the fuel injection device in which the fundamental design is essentially the same as the embodiment according to FIG. 1, but the disposition and embodiment of the second control valve 268 has been modified. The second control valve 268 can be electrically controlled and has an actuator 269, which can be an electromagnet or a piezoelectric actuator, which is electrically activated and can move a valve member of the control valve 268. On one side, the second control valve 268 is connected to the line 14 and on the other side, it is connected to the conduit 54, which leads to the pressure chamber 40, and the connection 56, which leads to the control pressure chamber 52. The second control valve 268 is embodied as a 3/2-port directional-control valve with which, in a first switching position, the connection 56 of the control pressure chamber 52 to the conduit 54 is shut off and conduit 54 is connected to the line 14 and therefore to the pump working chamber 22. In a second switching position of the second control valve 268, it shuts the line 14 and therefore the pump working chamber 22 from the conduit 54 off and connects the conduit 54 to the control pressure chamber 52. The control pressure chamber 52 has a connection 270 to the discharge chamber 24, which connection contains a check valve 272 that opens in the direction of the discharge chamber 24 and can also contain a throttle restriction. In order to permit the fuel injection valve 12 to open, the second control valve 268 remains in its first switching position in which the control pressure chamber 52 is shut off from the conduit 54 and the conduit 54 is connected to the line 14 so that the pressure generated by the fuel pump 10 travels into the pressure chamber 40 of the fuel injection valve 12, as a result of which the control pressure chamber 52 is discharged into the discharge chamber 24. In order to close the fuel injection valve 12, the second control valve 268 is brought into its second switching position in which the control pressure chamber 52 is connected to the conduit 54, but the conduit 54 is shut off from the line 14. The pressure prevailing in the pressure chamber 40 of the fuel injection valve 12 thereby also prevails in the control pressure chamber 52, as a result of which the fuel injection valve 12 is closed. Otherwise, the operation of the fuel injection device according to this modified embodiment is equivalent to the one according to FIG. 1.

The foregoing relates to preferred exemplary embodiments of the invention, it being understood that other variants and embodiments thereof are possible within the spirit and scope of the invention, the latter being defined by the appended claims.

We claim:

1. A fuel injection device for internal combustion engines, comprising a fuel pump (10) for each cylinder of the engine, which fuel pump (10) has a pump piston (18) that is driven in a stroke motion by the engine and delimits a pump working chamber (22), which is supplied with fuel from a fuel tank (9)

a fuel injection valve (12) connected to the fuel pump, the fuel injection valve having an injection valve member (28) that controls at least one injection opening (32) and can be moved by the pressure prevailing in a pressure chamber (40) connected to the pump working chamber (22) in an opening direction (29) counter to a closing force, a first electrically controlled control valve (60) that controls a connection (59) of the pump working chamber (22) to a discharge chamber (24), a second electrically controlled control valve (68, or 168, or 268) that controls the pressure prevailing in a control pressure chamber (52) of the fuel injection valve (12), which pressure acts at least indirectly on the injection valve member (28) in the closing direction, and a pressure-holding valve (62), which opens in the direction of the first control valve (60), situated between the pump working chamber (22) and the first control valve (60), thereby maintaining in the communication line (14) between the pressure chamber (40) of the fuel injection valve (12) and the pump work chamber (22), and in the pressure chamber (40), an elevated pressure compared to the relief chamber (24).

2. The fuel injection device according to claim 1, further comprising a check valve (25), which opens in the direction of the pressure-holding valve (62) situated between the pump working chamber (22) and the pressure-holding valve (62), and a connection (13) to the fuel tank (9) or to a storage region (24) between the check valve (25), and the pump working chamber (22).

3. The fuel injection device according to claim 1, wherein the second control valve (168) is embodied as a 3/2-port directional-control valve with which, in a first switching position, the control pressure chamber (52) is connected to the pump working chamber (22) and is shut off from a discharge chamber (24) and in a second switching position, the control pressure chamber (52) is connected to the discharge chamber (24) and is shut off from the pump working chamber (22).

4. The fuel injection device according to claim 2, wherein the second control valve (168) is embodied as a 3/2-port directional-control valve with which, in a first switching position, the control pressure chamber (52) is connected to the pump working chamber (22) and is shut off from a discharge chamber (24) and in a second switching position, the control pressure chamber (52) is connected to the discharge chamber (24) and is shut off from the pump working chamber (22).

5. The fuel injection device according to claim 1, wherein the second control valve (268) is embodied as a 3/2-port directional-control valve with which, in a first switching position, the control pressure chamber (52) is shut off from a pressure chamber (40) of the fuel injection valve (12) and the pressure chamber (40) is connected to the pump working chamber (22) and in a second switching position, the control pressure chamber (52) is connected to the pressure chamber (40) and the pressure chamber (40) is shut off from the pump working chamber (22).

6. The fuel injection device according to claim 2, wherein the second control valve (268) is embodied as a 3/2-port directional-control valve with which, in a first switching position, the control pressure chamber (52) is shut off from a pressure chamber (40) of the fuel injection valve (12) and the pressure chamber (40) is connected to the pump working chamber (22) and in a second switching position, the control pressure chamber (52) is connected to the pressure chamber (40) and the pressure chamber (40) is shut off from the pump working chamber (22).

7. The fuel injection device according to claim 5, wherein the control pressure chamber (52) has a connection (270) to a discharge chamber (24), which preferably contains a check valve (272) that opens in the direction of the discharge chamber (24).

8. The fuel injection device according to claim 6, wherein the control pressure chamber (52) has a connection (270) to a discharge chamber (24), which preferably contains a check valve (272) that opens in the direction of the discharge chamber (24).

* * * * *